US008407936B1

(12) United States Patent
Lee, Jr.

(10) Patent No.: US 8,407,936 B1
(45) Date of Patent: Apr. 2, 2013

(54) PLANT BELT SYSTEM

(76) Inventor: Donald V. Lee, Jr., Indian Trail, NC (US)

( * ) Notice: Subject to any disclaimer, the term of this patent is extended or adjusted under 35 U.S.C. 154(b) by 303 days.

(21) Appl. No.: 12/961,541

(22) Filed: Dec. 7, 2010

(51) Int. Cl.
*A47G 7/00* (2006.01)

(52) U.S. Cl. ..... 47/67

(58) Field of Classification Search ..... 47/65.5, 47/66.6, 66.7, 67, 72, 20.1, 1.01 R, 32.3, 47/32.4, 32.6, 65; 224/269, 584, 690–692; 248/218.4, 219.3, 219.4
See application file for complete search history.

(56) References Cited

U.S. PATENT DOCUMENTS

| | | | | |
|---|---|---|---|---|
| 1,506,668 | A * | 8/1924 | Rose et al. | 211/107 |
| 2,726,397 | A * | 12/1955 | Stirton | 2/48 |
| 2,967,691 | A | 1/1961 | Lehnbeuter et al. | |
| D210,302 | S | 2/1968 | Lansford et al. | |
| 4,144,673 | A * | 3/1979 | Quast et al. | 47/57.5 |
| 4,676,419 | A * | 6/1987 | Victor | 224/649 |
| 5,004,136 | A * | 4/1991 | Leath | 224/148.5 |
| D346,344 | S | 4/1994 | Vincent | |
| 5,408,782 | A * | 4/1995 | McConnell | 182/187 |
| D366,734 | S * | 1/1996 | Arthur | D29/124 |
| D369,123 | S | 4/1996 | D'Alessandro | |
| 6,216,931 | B1 * | 4/2001 | Trawinski | 224/583 |
| D450,624 | S | 11/2001 | Stern | |
| 6,752,279 | B1 | 6/2004 | Dwyer | |
| 7,552,904 | B2 * | 6/2009 | Zehnder et al. | 248/682 |
| 2008/0078121 | A1 | 4/2008 | Stanio | |

* cited by examiner

*Primary Examiner* — Kimberly Berona
*Assistant Examiner* — Ebony Evans
(74) *Attorney, Agent, or Firm* — Montgomery Patent and Design LLC; Robert C. Montgomery

(57) ABSTRACT

A flower belt comprises a belt member and a plurality of belt attachments. The belt member comprises a durable, flexible elongated body with an adjustable securing means designed to securely affix around a tree trunk. The belt member further comprises a hook attachment means which enables the securing and removably receiving the plurality of belt attachments. The hook attachment comprises hooks outwardly disposed for suspending the belt attachments.

13 Claims, 12 Drawing Sheets

PLANT BELT SYSTEM

RELATED APPLICATIONS

The present invention was first described in a notarized Official Record of Invention on Oct. 12, 2009, that is on file at the offices of Montgomery Patent and Design, LLC, the entire disclosures of which are incorporated herein by reference.

FIELD OF THE INVENTION

The present invention relates generally to the display of decorative plants, and in particular, to a customizable display system particularly adapted for the display of a variety of types of plants along vertical structures.

BACKGROUND OF THE INVENTION

Plants and flowers are popular means for providing natural aesthetic enhancements to homes and gardens. Often times, such plants are utilized in a variety of combinations in order to provide an expansive, colorful aesthetic appeal that enhances the value and enjoyment of a particular area. A common method for the display of plants is the use of pots or planters. Furthermore, many plants are sold in such containers in order to facilitate storage, transportation, caretaking, growth in a variety of locations, and to maintain cleanliness. Many people place such plants in pots in both indoor and outdoor environments to make planting and tending easier.

One (1) problem associated with the display of plants is a lack of suitable locations for plant pots. For instance, in outdoors locations distant from housing structures, there is a paucity of flat or raised surfaces which are desirable for the support and display of potted plants. Such potted plants may be hung, but it is often difficult or undesirable to do so due to lack of suitable structures, permanent damage caused to the structure, difficulty of installation, or the like.

Various attempts have been made to provide plant housing and display devices for vertical surfaces. Examples of these attempts can be seen by reference to several U.S. patents. U.S. Pat. No. 2,967,691, issued in the name of Lehnbeuter et al., describes a flower pot holder for mounting to a vertical wall surface or the like.

U.S. Pat. No. 6,752,279, issued in the name of Dwyer, describes a plurality of flower pot holders and a mounting strap for use on a tree trunk or the like.

Additionally, ornamental designs for a tree mountable flower pot holders exist, particularly U.S. Pat. Nos. D 210, 302, D 369,123, and D 450,624. However, none of these designs are similar to the present invention.

While these devices fulfill their respective, particular objectives, each of these references suffer from one (1) or more of the aforementioned disadvantages. Many such devices result in damage to a vertical surface or structure to which they are mounted. Also, many such devices are not readily adjustable for structures of varying shape and size. Furthermore, many such devices are only adapted for a particular size or shape of potted plant. In addition, many such devices do not provide any features of customizability regarding the relative positioning and types of plants or pots supported. Accordingly, there exists a need for a vertically mountable plant display system without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a system which is adaptable for use with a variety of types and sizes of vertical structures in a manner that allows a user a wide range of adaptability to various types, sizes, and configurations of plants and plant containers. Thus, the object of the present invention is to solve the aforementioned disadvantages and provide for this need.

To achieve the above objectives, it is an object of the present invention to provide a means for attaching potted plants, non-potted plants, and various other plant display methods to a verity structure such as a tree or post. The system comprises a belt member, a plurality of pocket attachments, a skirt attachment, a pocketed skirt attachment, and a plurality of sleeve attachments.

Another object of the present invention is to enable selectable vertical positioning of the belt member along a vertical structure. The belt member comprises a durable strap which encompasses the structure.

Yet still another object of the present invention is to provide secure attachment of the belt member to a variety of differently size and shaped structures via relatively adjustable hook-and-loop-type fastening portions located at opposing ends of the belt member.

Yet still another object of the present invention is to provide a means to selectively display a potted plant along the belt member via the plurality of pocket attachments. Each pocket attachment comprises an open-topped pocket structure with an integral hook portion which allows for secure, adjustable hanging of the pocket along the belt member.

Yet still another object of the present invention is to provide a means to encircle a lower portion of a structure in a flowered sheeting means via the skirt attachment. The skirt attachment comprises a large, flat fabric structure which is attachable to the belt member via a plurality of integral hook portions in order to provide a round, conical covering to the base of the structure between the belt and a ground surface.

Yet still another object of the present invention is to provide an integral flowering means to the skirt attachment. The skirt surface is impregnated with seeds during a manufacturing process, thereby allowing for organic growth of flowers along a top surface of skirt once positioned about a structure.

Yet still another object of the present invention is to comprise a pocketed skirt attachment which provides an encircling flowering means similar to the skirt attachment. The pocketed skirt attachment further comprises a plurality of integrally sewn-in pockets which provide a means for the secure display of a plurality of pots or plants about the exterior of the pocketed skirt attachment.

Yet still another object of the present invention is to comprise a plurality of sleeve attachments which provide a means for the secure retention of a volume of soil and a non-potted plant for display about a structure. Each sleeve attachment is selectively securable about the belt member via an integral hook portion.

Yet still another object of the present invention is to provide a method of utilizing the device that provides a unique means of obtaining an instance of the system, securing the belt member about a desired structure at a desired height via the hook and loop fastening portions, selectively positioning and securing a desired combination of pocket, skirt, pocketed skirt, and sleeve attachments to the belt member, selectively watering the skirt and pocketed skirt attachments to facilitate integral flowering, and selectively providing the pocket, pocketed skirt, or sleeve attachments with a desired combination of existing potted and non-potted plants in order to achieve a desired overall aesthetic appearance.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
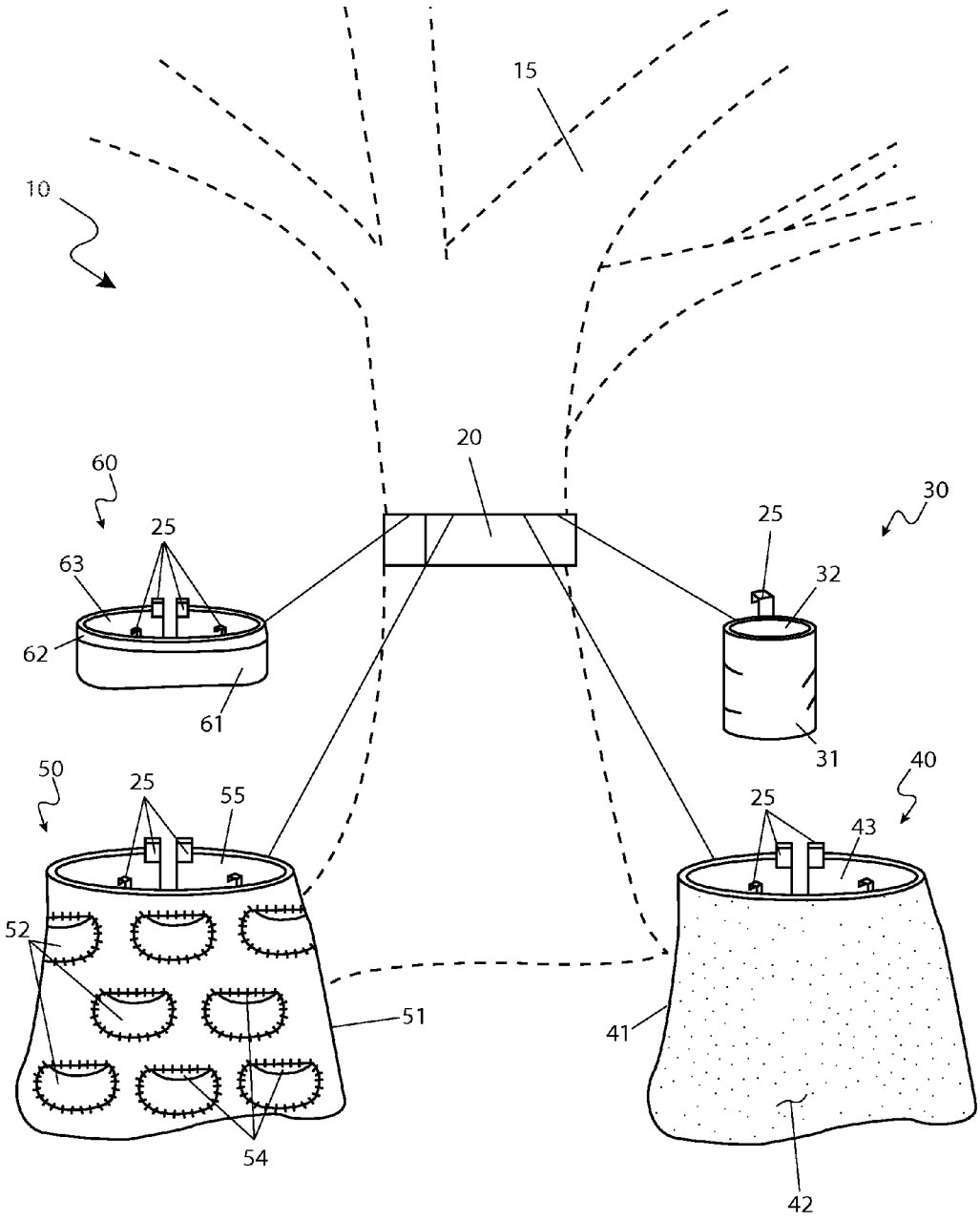
FIG. 1 is an environmental view of a plant belt system 10, according to a preferred embodiment of the present invention.

10 plant belt system
15 tree
16 potted plant
17 non-potted plant
20 belt member
21 hook fastener
22 loop fastener
25 hook
26 adhesive
30 pocket attachment
31 pocket
32 pocket interior
40 skirt attachment
41 skirt outer surface
42 seed
43 skirt inner surface
50 pocketed skirt attachment
51 pocketed skirt outer surface
52 pocketed skirt pocket
53 sewing technique
54 pocketed skirt interior portion
55 pocketed skirt inner surface
60 sleeve attachment
61 sleeve outer surface
62 sleeve interior pocket surface
63 sleeve inner surface

DETAILED DESCRIPTION OF THE PREFERRED EMBODIMENT

The best mode for carrying out the invention is presented in terms of its preferred embodiment, herein depicted within FIGS. 1 through 12. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a plant belt system (herein described as the "system") 10, which provides a means for attaching potted plants 16, non-potted plants 17, or the like onto a tree 15, a post, or other similar vertical structure to create an aesthetically pleasing displaying means to a variety of flowering plants. Referring now to FIG. 1, an environmental view of the system 10, according to the preferred embodiment of the present invention, is disclosed. The system 10 comprises a belt member 20 which provides an attachment means to a tree 15 and further enables attachment to a pocket attachment 30, a skirt attachment 40, a pocketed skirt attachment 50, and a sleeve attachment 60. The belt member 20 and attachments 30, 40, 50, 60 may comprise various measurements to accommodate various sized vertical structures.

Figure 2:
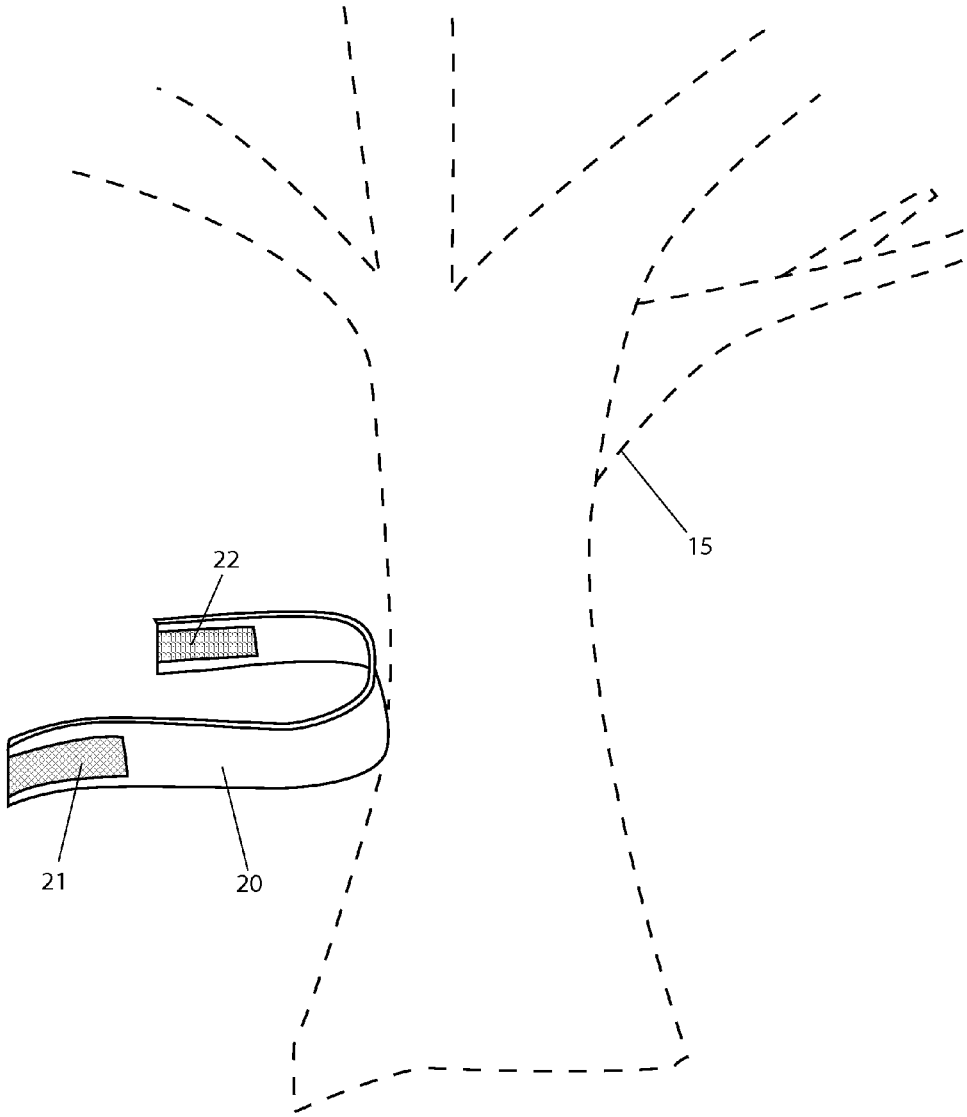
FIG. 2 is a perspective view of a belt member 20, according to a preferred embodiment of the present invention.
Figure 3:
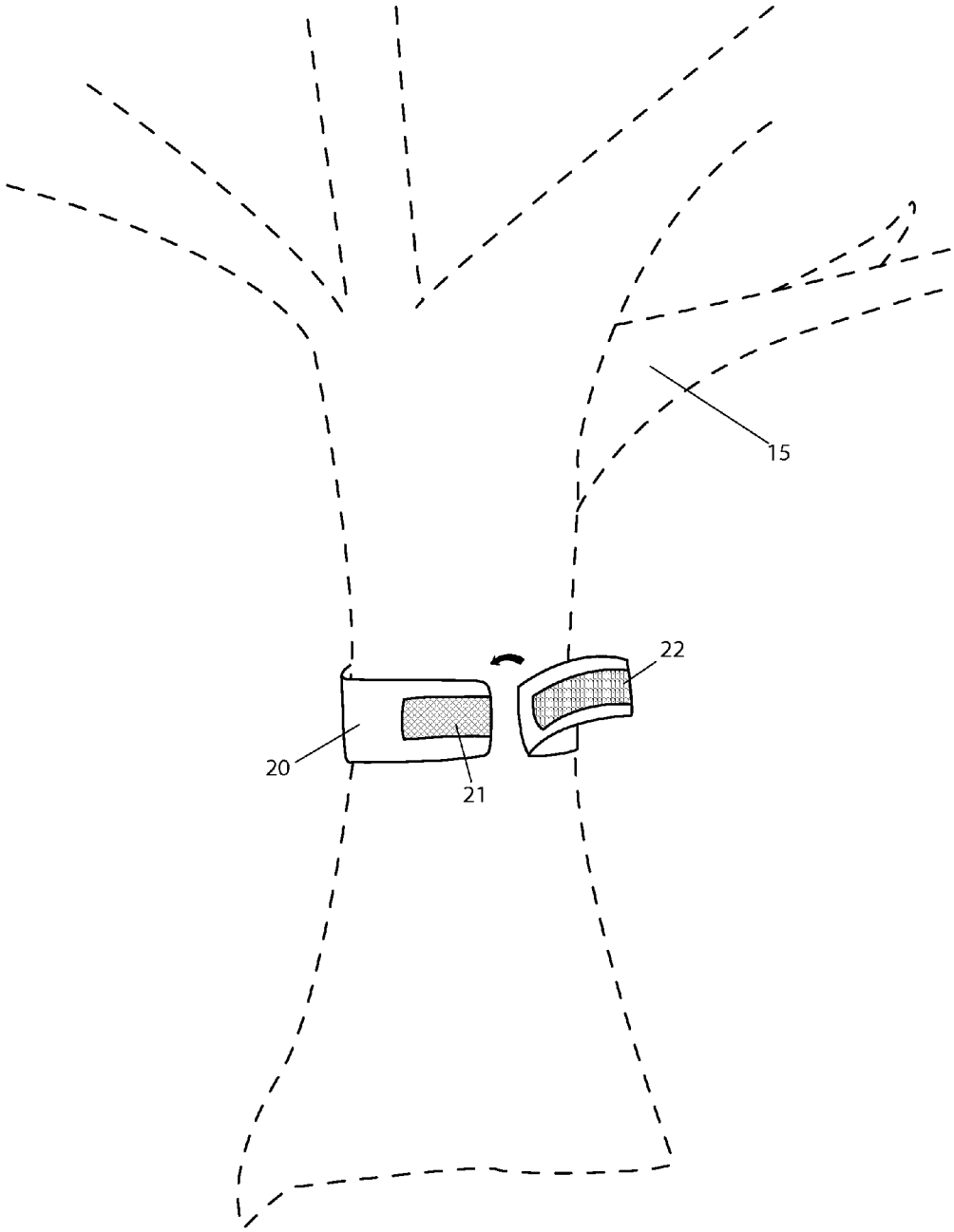
FIG. 3 is a front view of the belt member 20 depicting placement on a tree 15, according to a preferred embodiment of the present invention.

Referring now to FIG. 2, a perspective view of the belt member 20 and FIG. 3, a front view of the belt member 20 depicting placement on a tree 15, according to the preferred embodiment of the present invention, are disclosed. The system 10 comprises a belt member 20 which enables a means to encompass a portion of the tree 15 and suspend each attachment 30, 40, 50, 60. The belt member 20 is preferably fabricated from a durable nylon in various colors or patterns, yet other materials may be utilized without limiting the scope of the system 10. The belt member 20 measures approximately four (4) inches in width and eight (8) feet in length, yet other measurements may be incorporated as abovementioned. The belt member 20 is wrapped around the tree 15 at a desired height and fastened via a hook fastener 21 engaging a loop fastener 22. The hook fastener 21 is located on an exterior end surface of the belt member 20 and the loop fastener 22 is located on an opposing interior surface of said belt member 20 to provide a proper engaging means.

Figure 4:
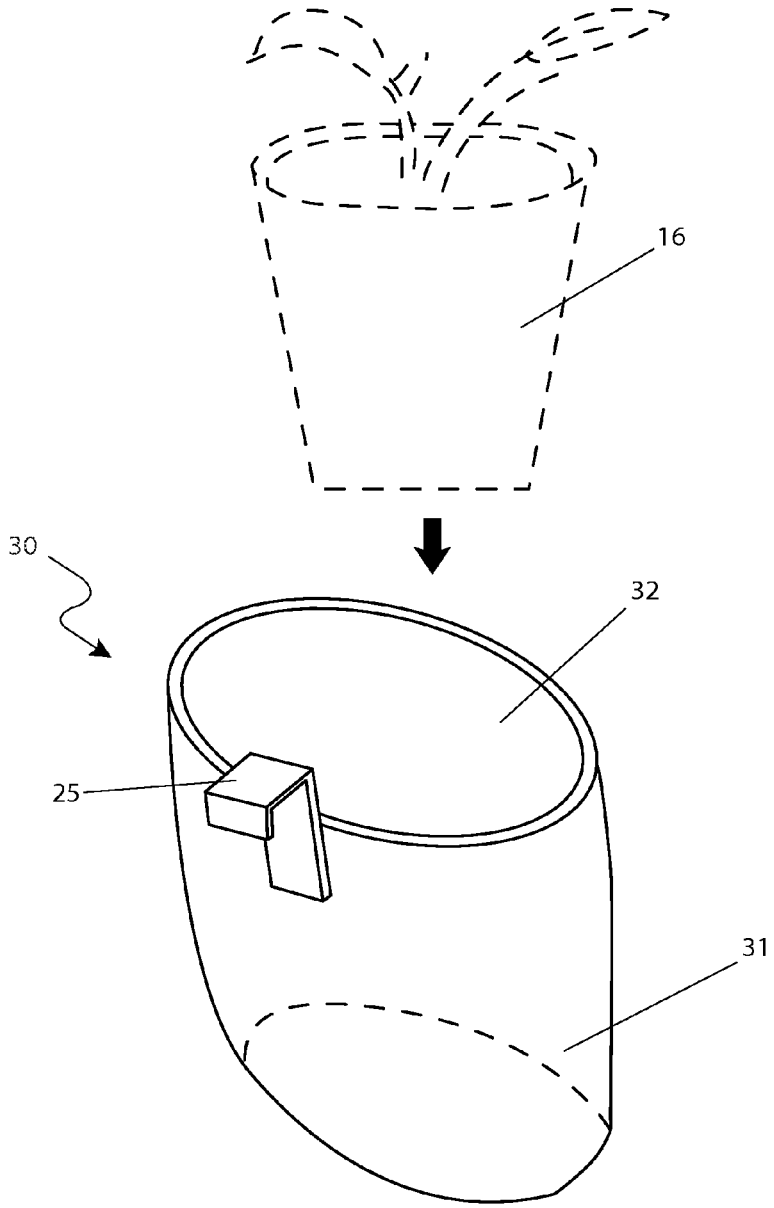
FIG. 4 is a rear perspective view of a pocket 30, according to a preferred embodiment of the present invention.
Figure 5:
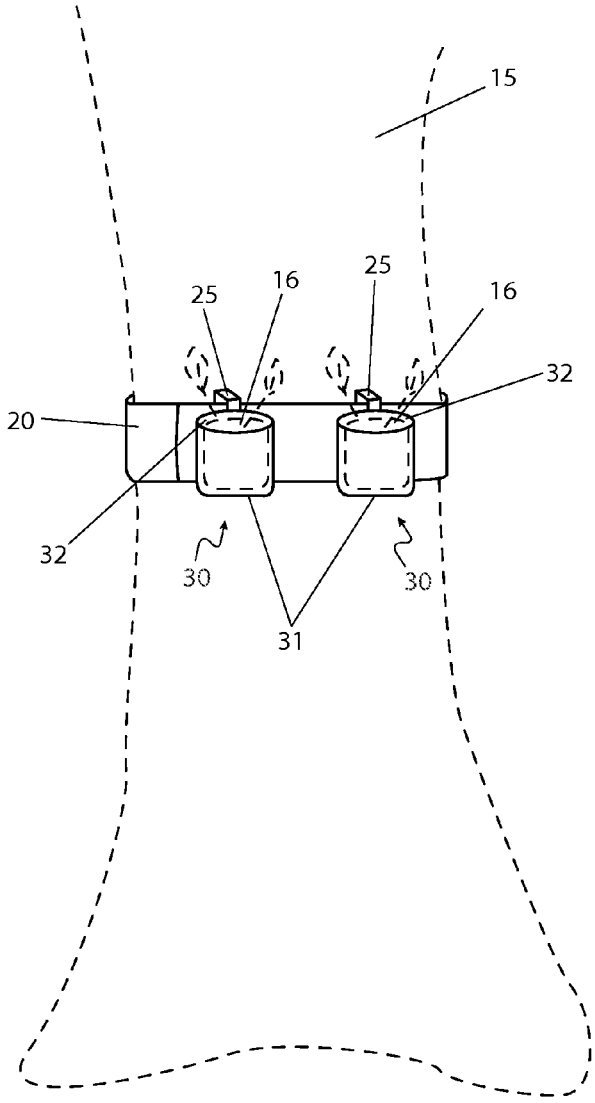
FIG. 5 is a front view of a plurality of pockets 30 depicting placement on the belt member 20 attached to the tree 15, according to a preferred embodiment of the present invention.

Referring now to FIG. 4, a rear perspective view of the pocket 30 and FIG. 5, a front view of the pocket 30 depicting placement on the belt member 20 attached to the tree 15, according to the preferred embodiment of the present invention, is disclosed. The system 10 also comprises a plurality of pocket attachments 30 which preferably provides a means to suspend a potted plant 16 or similar plant from the belt member 20. The pocket attachment 30 comprises a pocket 31 and a pocket interior 32 and is fabricated from a durable nylon similar to the belt member 20. The pocket 31 comprises a cylindrical cup-shape with an open upper panel to enable placement of the potted plant 16 into the pocket interior 31. The pocket attachment 30 is suspended from the belt member 20 via an inverted "L"-shaped hook 25. Each hook 25 is bonded to a rear exterior perimeter surface of the pocket 31 via an adhesive 26, yet other attachment means may be utilized without limiting the scope of the system 10. The pocket attachment 30 is suspended from the belt member 20 via engaging the hook 25 with the upper perimeter edge of said belt member 20. The hook 25 is preferably fabricated from a plastic, yet other materials such as metal may be utilized without limiting the scope of the system 10.

Figure 6:
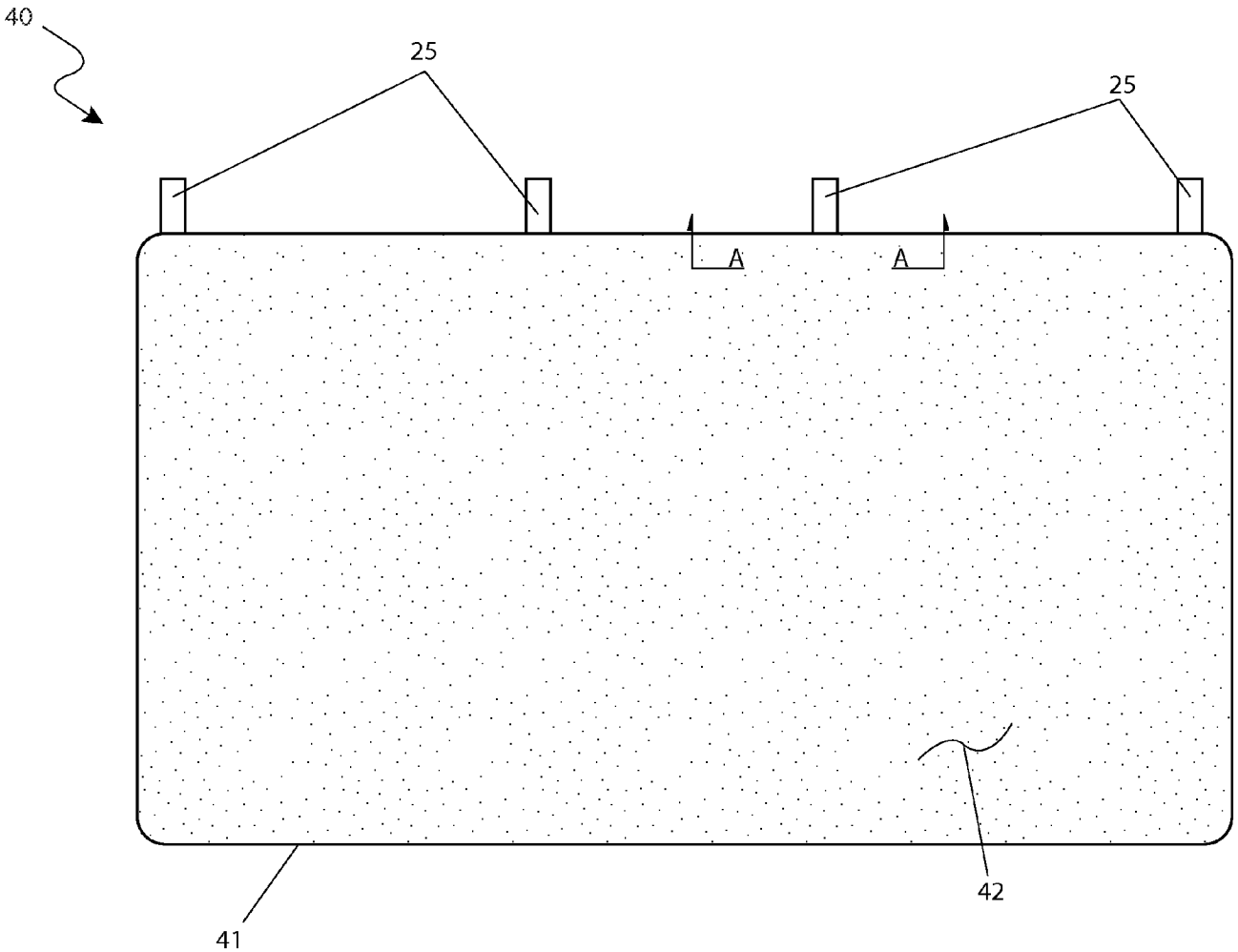
FIG. 6 is a front view of a skirt 40, according to a preferred embodiment of the present invention.
Figure 7:
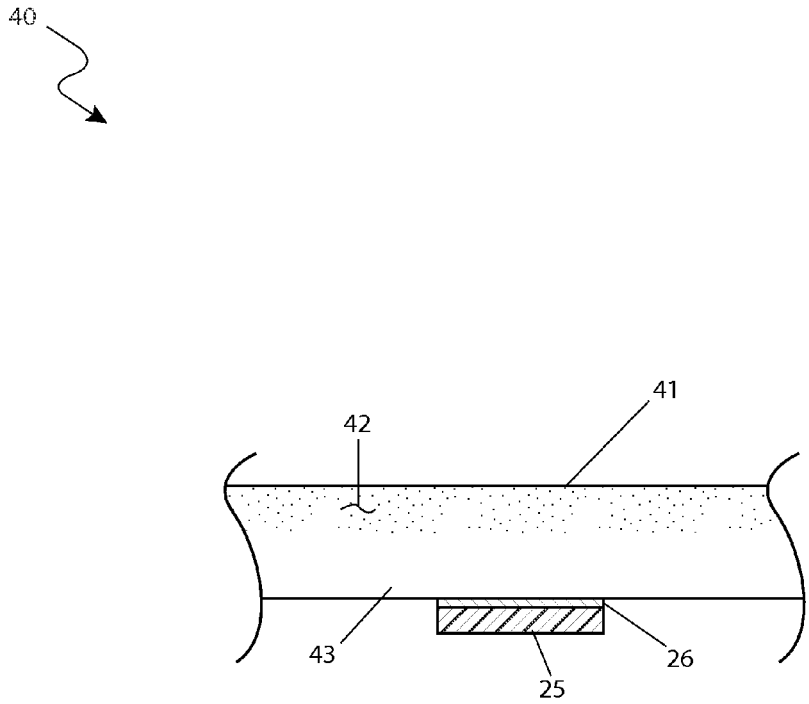
FIG. 7 is a section view of the skirt 40 taken along line A-A (see FIG. 7), according to a preferred embodiment of the present invention.
Figure 8:
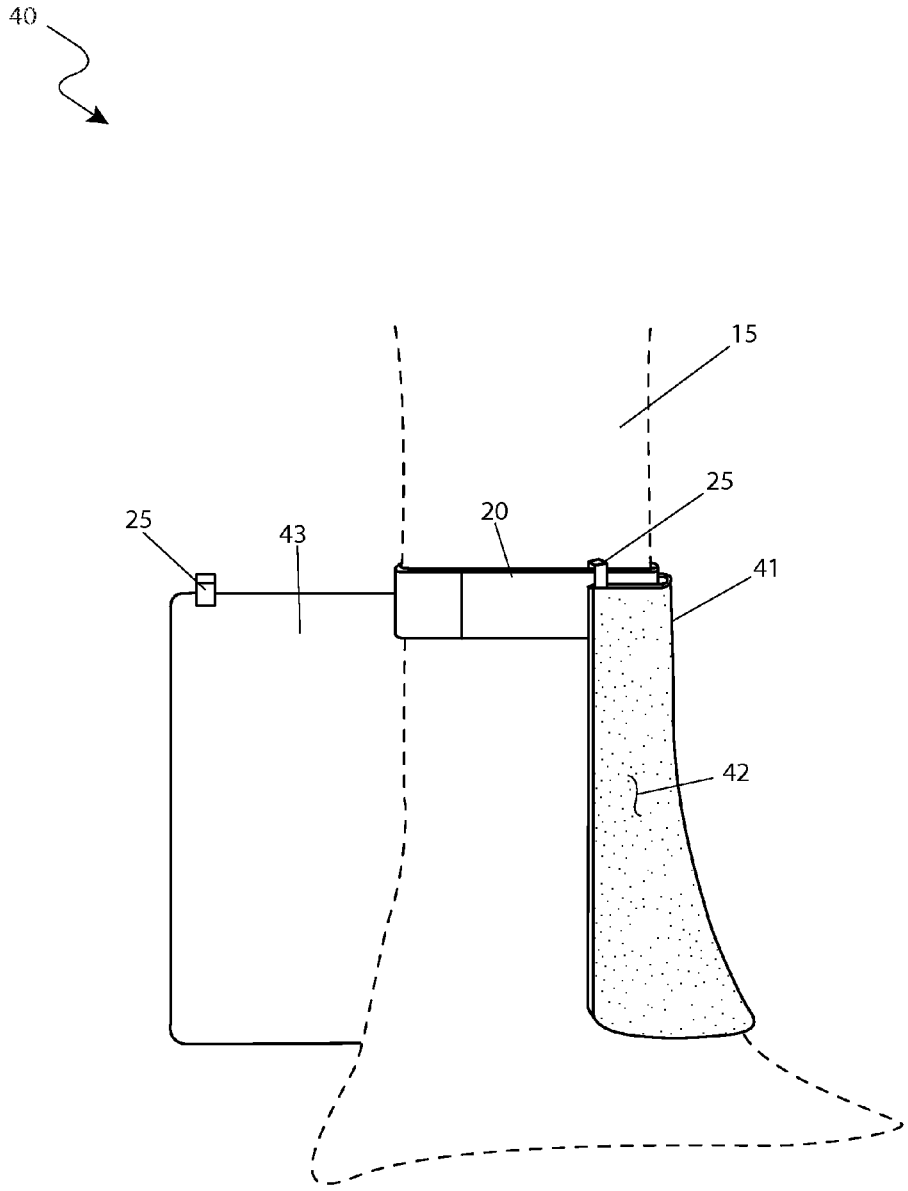
FIG. 8 is an environmental view of the skirt 40 depicting placement on the belt member 20 on the tree 15, according to a preferred embodiment of the present invention.

Referring now to FIG. 6, a front view of the skirt 40, FIG. 7, a section view of the skirt 40 taken along line A-A (see FIG. 7), and FIG. 8, an environmental view of the skirt 40 depicting placement on the belt member 20 on the tree 15, according to the preferred embodiment of the present invention, are disclosed. The system 10 further comprises a skirt attachment 40 which provides a means to envelope a base portion of the tree 15 in a flowering sheeted means. The skirt attachment 40 comprises a skirt outer surface 41 and a skirt inner surface 42 and is preferably fabricated from a biodegradable paper material. The skirt outer surface 41 and a skirt inner surface 42 measure approximately one (1) inch in thickness and eight (8) feet in length, yet other measurements may be incorporated without limiting the scope of the system 10. The skirt outer surface 41 is impregnated with a plurality of seeds 42 which provide a flowering means to the skirt attachment 40. The seeds 42 may comprise various flowering plant seeds which sprout outwardly from the skirt outer surface 41 once watered in a common manner. The skirt outer surface 41 is preferably impregnated with the seeds 42 during the manufacturing process to enable said seeds 42 to become embedded within said skirt outer surface 41. The skirt attachment 40 is suspended from the belt member 20 via a plurality of hooks 25 which are attached to a lateral perimeter edge of the skirt inner surface 43 via adhesive 26 as abovementioned. The skirt attachment 40 is wrapped around the tree 15 and the hooks 25 engage the upper perimeter edge of said belt member 20 to suspended said skirt attachment 40 to said belt member 20.

Figure 9:
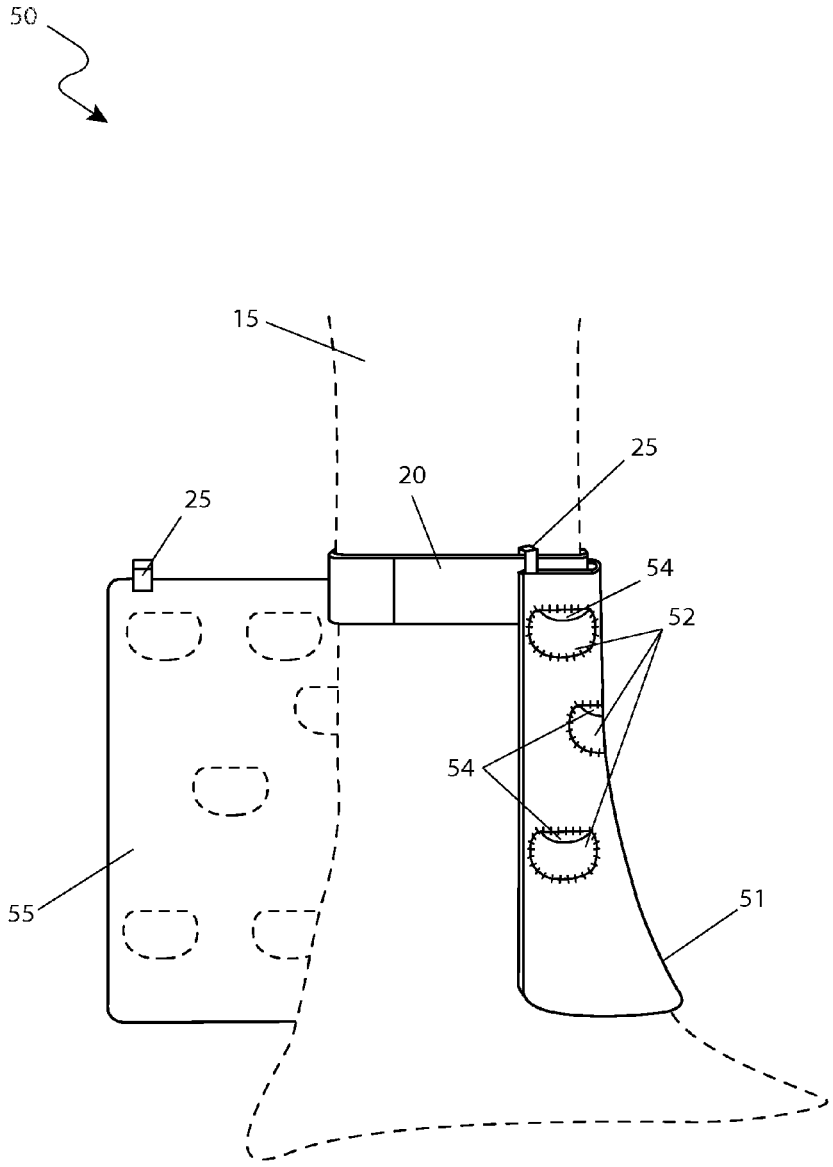
FIG. 9 is an environmental view of a pocketed skirt 50 depicting placement on the belt member 20 on the tree 15, according to a preferred embodiment of the present invention.
Figure 10:
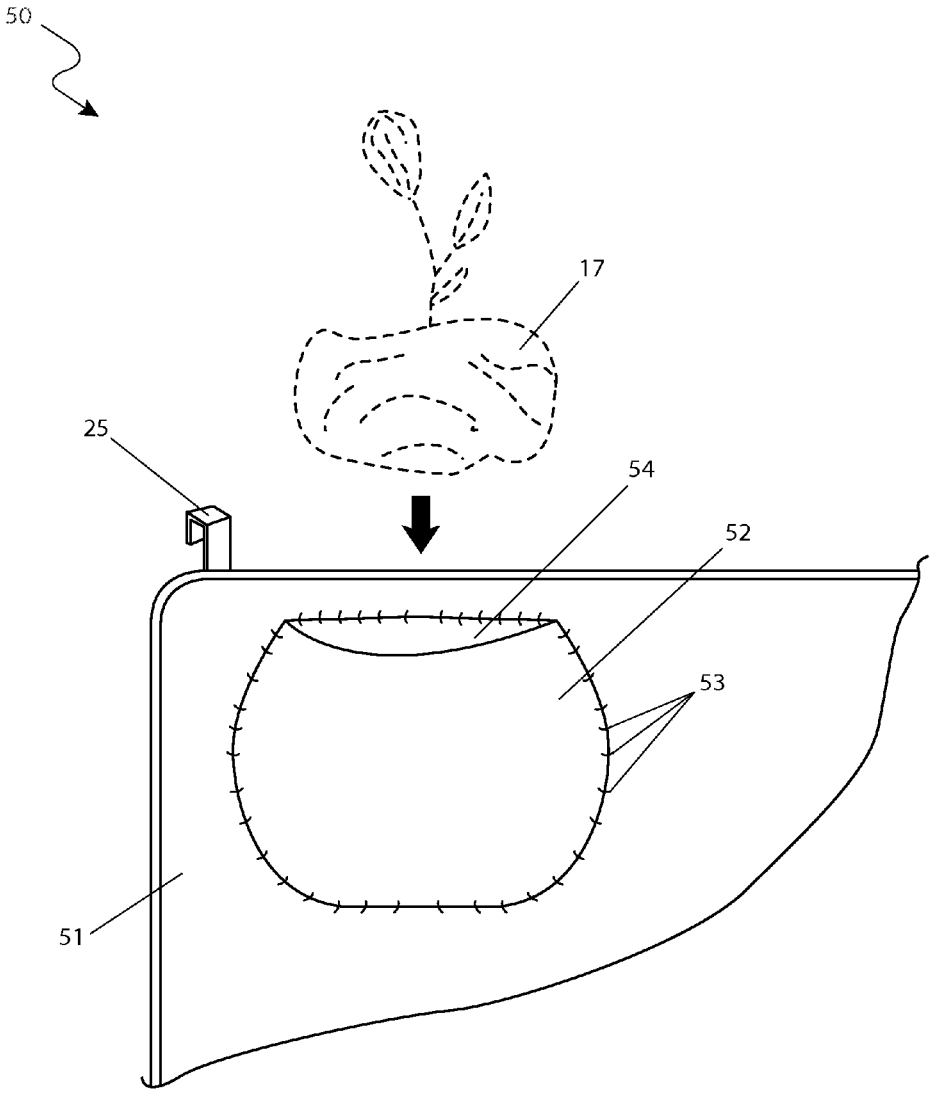
FIG. 10 is a partial view of the pocketed skirt 50, according to a preferred embodiment of the present invention.

Referring now to FIG. 9, an environmental view of a pocketed skirt 50 depicting placement on the belt member 20 on the tree 15 and FIG. 10, partial view of the pocketed skirt 50, according to the preferred embodiment of the present invention, is disclosed. The system 10 further comprises a pocketed skirt attachment 50 which provides another attachment means to the belt member 20 to display a plurality of non-potted plants 17 or the like. The pocketed skirt 50 comprises a pocketed outer surface 51 which further comprises a plurality of pocketed skirt pockets 52. The pocketed skirt pockets 52 are attached to the pocketed skirt outer surface 51 via conventional sewing techniques 53 and preferably enable a desired amount of non-potted plants 17 to be inserted into the pocketed skirt interior portion 54 which further enable the non-potted plants 17 to grow within each pocketed skirt pocket 52. The pocketed skirt attachment 50 is suspended from the belt member 20 via a plurality of hooks 25 attached to an upper perimeter lateral edge of a pocketed skirt inner surface 55 via adhesives 26 as abovementioned. The pocketed skirt attachment 50 is similar in size and material to the skirt attachment 40 (see FIGS. 6 through 8).

Figure 11:
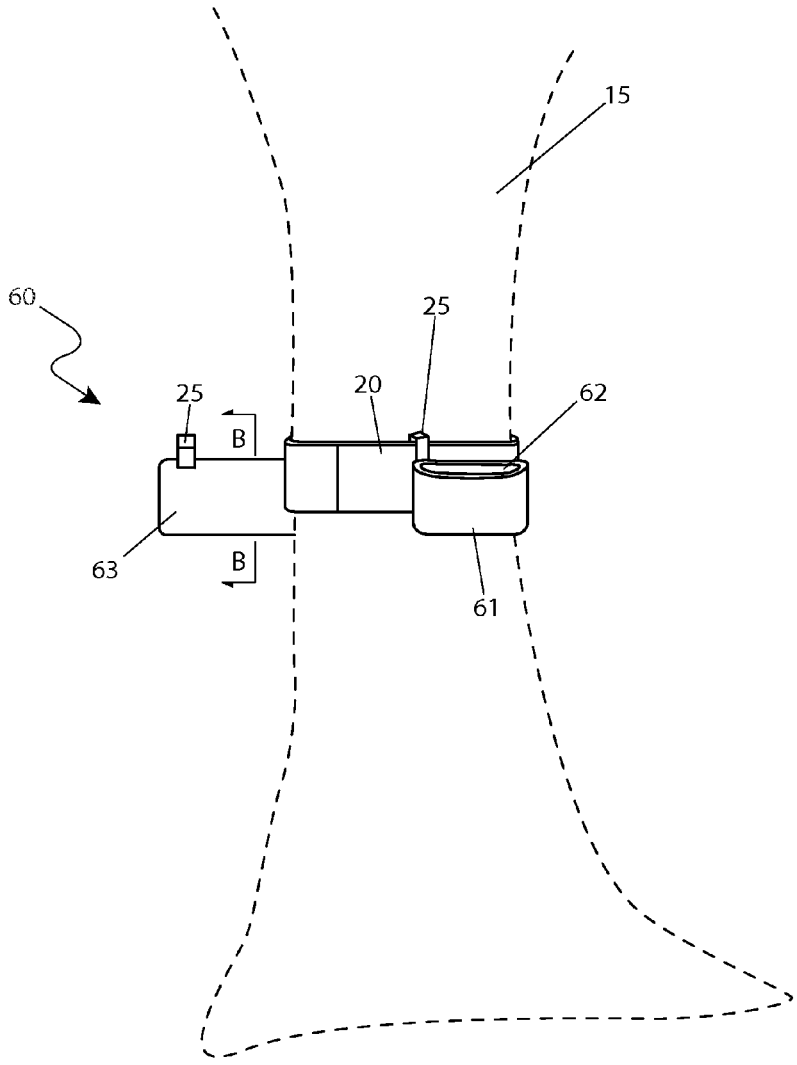
FIG. 11 is an environmental view of a sleeve 60 depicting placement on the belt member 20 on the tree 15, according to a preferred embodiment of the present invention; and, FIG. 12 is a section view of the sleeve 60 taken along line B-B (see FIG. 11), according to a preferred embodiment of the present invention.
Figure 12:
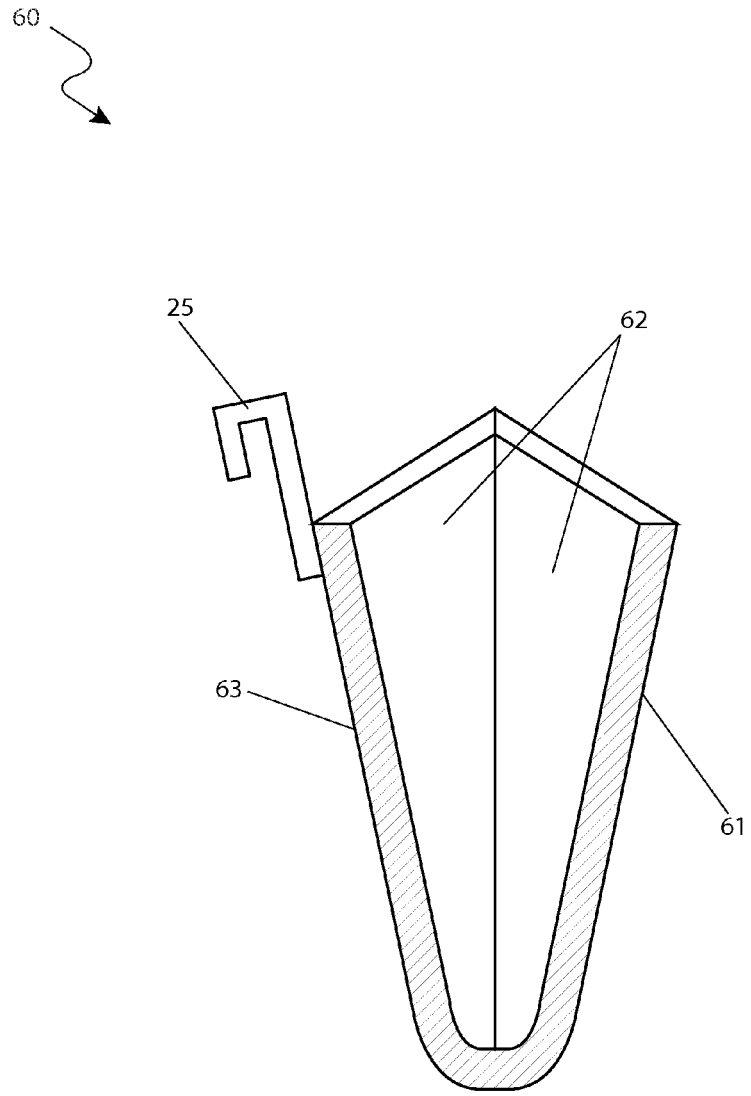

Referring now to FIG. 11, an environmental view of a sleeve 60 depicting placement on the belt member 20 on the tree 15 and FIG. 12, a section view of the sleeve 60 taken along line B-B (see FIG. 11), according to the preferred embodiment of the present invention, are disclosed. The system 10 yet further comprises a sleeve attachment 60 which provides a means of suspending non-potted plants 17 from the belt member 20. The sleeve attachment 60 comprises a sleeve outer surface 61, a sleeve interior surface 62, and a sleeve inner surface 63. The sleeve attachment 60 is suspended from the belt member 20 via a plurality of hooks 25 attached to the upper perimeter lateral edge of the sleeve inner surface 63. The sleeve attachment 60 is wrapped around the tree 15 and the hooks 25 engage the upper perimeter edge of said belt member 20 to suspended said sleeve attachment 60 to said belt member 20. The sleeve outer surface and the sleeve inner surface 63 form a sleeve interior pocket surface 62 to position non-potted plants 17 or the like within. The sleeve outer surface 61 and the sleeve inner surface 63 are fabricated from a biodegradable paper material, yet other materials may be utilized without limiting the scope of the system 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: acquiring the system 10; fastening the belt member 20 onto a desired tree 15 or similar vertical surface via engaging the hook fastener 21 to the loop fastener 22; attaching a desired attachment 30, 40, 50 60 to the belt member 20 via engaging each hook 25 with the upper perimeter edge of the belt member 20 via suspending said desired attachment 30, 40, 50, 60; and, supporting potted plants 16 and non-potted plants 17 in a manner which is not only quick, easy, and effective, but aesthetically pleasing as well.

The method of utilizing the pocket attachment 30 may be achieved by performing the following steps: suspending the hook 25 on the pocket 31 onto the belt member 20 and repeating for each pocket 31; inserting a potted plant 16 into each pocket interior 32; caring for the potted plant 16 as desired; and removing the pocket attachment 30 from the belt member 20 as necessary.

The method of utilizing the skirt attachment 40 may be achieved by performing the following steps: suspending the hooks 25 on the skirt outer surface 43 onto the belt member 20 and wrapping the skirt attachment 40 around said belt member 20; watering the skirt outer surface 41 to enable growth of the seeds 42; and, removing the skirt attachment 30 from the belt member 20 as necessary.

The method of utilizing the pocketed skirt attachment 50 may be achieved by performing the following steps: suspending the hooks 25 on the pocketed skirt inner surface 55 onto the belt member 20 and wrapping the pocketed skirt outer surface 51 around said belt member 20; positioning a desired amount of non-potted plants 17 into a desired amount of pocketed skirt interior portions 54; watering each pocketed skirt pockets 52 as desired; and, removing the pocketed skirt attachment 50 from the belt member 20 as necessary.

The method of utilizing the sleeve attachment 60 may be achieved by performing the following steps: suspending the hooks 25 on the sleeve inner surface 63 onto the belt member 20 and wrapping the sleeve outer surface 61 around said belt member 20; positioning a desired amount of non-potted plants 17 into sleeve interior pocket surface 62; watering as desired; and, removing the sleeve attachment 60 from the belt member 20 as necessary.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A plant belt system for attaching and displaying potted and non-potted flowering plants onto a vertical structure, said plant belt system comprising:

a belt member adapted to be attached to a tree;

a plurality of pocket attachments, a skirt attachment, a pocketed skirt attachment, and a sleeve attachment; and, a plurality of inverted L-shaped hooks selectively connected to said belt member and at least one of said pocket attachments, said skirt attachment, said pocketed skirt attachment, and said sleeve attachment respectively;

wherein said pocket attachments, said skirt attachment, said pocketed skirt attachment and said sleeve attachment are selectively attached to said belt member; and, wherein said pocket attachments, said skirt attachment, said pocketed skirt attachment and said sleeve attachment are selectively suspended above ground when attached to said belt member.

2. The plant belt system of claim 1, wherein said belt member comprises:

a hook fastener located on an exterior end surface of said belt member; and, a loop fastener located on an opposing interior end surface of said belt member; wherein said loop fastener is removably engaged to said hook fastener.

3. The plant belt system of claim 2, wherein each of said pocket attachments comprises:

a pocket having a pocket interior;

wherein one of said inverted L-shaped hooks is connected to a rear exterior perimeter surface of said pocket;

wherein said pocket has a cylindrical cup-shape with an open upper panel adapted to receive the potted plant into said pocket interior; and, wherein each of said pocket attachments is suspended from said belt member when said one inverted L-shaped hook is engaged with an upper perimeter edge of said belt member.

4. The plant belt system of claim 2, wherein said skirt attachment comprises:

a skirt outer surface;

a skirt inner surface; and, a plurality of seeds impregnated with said skirt outer surface, said seeds sprouting outwardly from said skirt outer surface;

wherein one of said inverted L-shaped hooks is attached to a lateral perimeter edge of said skirt inner surface;

wherein said skirt attachment is adapted to be wrapped around the tree such that said one L-shaped hook engages an upper perimeter edge of said belt member; and, wherein said skirt attachment is suspended from said belt member via said one inverted L-shaped hook.

5. The plant belt system of claim 2, wherein said pocketed skirt attachment comprises:

a skirt outer surface;

a skirt inner surface; and, a plurality of skirt pockets having skirt interior portions, said skirt pockets being attached to said skirt outer surface, wherein said skirt pockets are adapted to receive the non-potted plants into said skirt interior portions such that the non-potted plants grow within each of said skirt pockets;

wherein one of said inverted L-shaped hooks is attached to an upper perimeter lateral edge of said skirt inner surface; and, wherein said skirt attachment is suspended from said belt member via said one inverted L-shaped hook.

6. The plant belt system of claim 2, wherein said sleeve attachment comprises:

a sleeve outer surface;

a sleeve interior surface; and, a sleeve inner surface;

wherein said sleeve outer surface and said sleeve inner surface form said sleeve interior pocket surface, said sleeve interior pocket surface being adapted to receive non-potted plants therein, wherein said sleeve attachment is adapted to be wrapped around the tree; and, wherein one of said inverted L-shaped hooks is attached to the upper perimeter lateral edge of said sleeve outer surface, said one inverted L-shaped hook further being engaged to an upper perimeter edge of said belt member and thereby suspending said sleeve attachment from said belt member.

7. A plant belt system for attaching and displaying potted and non-potted flowering plants onto a vertical structure, said plant belt system comprising:

a belt member adapted to be attached to a tree;

a plurality of pocket attachments, a skirt attachment, a pocketed skirt attachment, and a sleeve attachment;

a plurality of inverted L-shaped hooks selectively connected to said belt member and at least one of said pocket attachments, said skirt attachment, said pocketed skirt attachment, and said sleeve attachment respectively;

wherein said pocket attachments, said skirt attachment, said pocketed skirt attachment and said sleeve attachment are selectively attached to said belt member;

wherein said pocket attachments, said skirt attachment, said pocketed skirt attachment and said sleeve attachment are selectively suspended above ground when attached to said belt member; and, wherein said sleeve attachment is adapted to selectively suspend non-potted plants above ground when attached to said belt member.

8. The plant belt system of claim 7, wherein said belt member comprises:

a hook fastener located on an exterior end surface of said belt member; and, a loop fastener located on an opposing interior end surface of said belt member; wherein said loop fastener is removably engaged to said hook fastener.

9. The plant belt system of claim 8, wherein each of said pocket attachments comprises: a pocket having a pocket interior;

wherein one of said inverted L-shaped hooks is connected to a rear exterior perimeter surface of said pocket;

wherein said pocket has a cylindrical cup-shape with an open upper panel adapted to receive the potted plant into said pocket interior; and, wherein said pocket attachment is suspended from said belt member when said one inverted L-shaped hook is engaged with an upper perimeter edge of said belt member.

10. The plant belt system of claim 8, wherein said skirt attachment comprises:

a skirt outer surface;

a skirt inner surface; and, a plurality of seeds impregnated with said skirt outer surface, said seeds sprouting outwardly from said skirt outer surface;

wherein one of said inverted L-shaped hooks is attached to a lateral perimeter edge of said skirt inner surface;

wherein said skirt attachment is adapted to be wrapped around the tree such that said one L-shaped hook engages an upper perimeter edge of said belt member; and, wherein said skirt attachment is suspended from said belt member via said one inverted L-shaped hook.

11. The plant belt system of claim 8, wherein said pocketed skirt attachment comprises:

a skirt outer surface;

a skirt inner surface; and, a plurality of skirt pockets having skirt interior portions, said skirt pockets being attached to said skirt outer surface, wherein said skirt pockets are adapted to receive the non-potted plants into said skirt interior portions such that the non-potted plants grow within each of said skirt pockets;

wherein one of said inverted L-shaped hooks is attached to an upper perimeter lateral edge of said skirt inner surface;

wherein said skirt attachment is suspended from said belt member via said one inverted L-shaped hook.

12. The plant belt system of claim 8, wherein said sleeve attachment comprises:

a sleeve outer surface;

a sleeve interior surface; and, a sleeve inner surface;

wherein said sleeve outer surface and said sleeve inner surface form said sleeve interior pocket surface, said sleeve interior pocket surface being adapted to receive non-potted plants therein, wherein said sleeve attachment is adapted to be wrapped around the tree; and, wherein one of said inverted L-shaped hooks is attached to the upper perimeter lateral edge of said sleeve outer surface, said one inverted L-shaped hook further being engaged to an upper perimeter edge of said belt member and thereby suspending said sleeve attachment from said belt member.

13. A method of utilizing a plant belt system for attaching and displaying potted and non-potted flowering plants onto a vertical structure, said method comprising the steps of:

providing and attaching a belt member to a tree;

providing a plurality of pocket attachments, a skirt attachment, a pocketed skirt attachment, and a sleeve attachment;

providing and selectively connecting a plurality of inverted L-shaped hooks to said belt member and at least one of said pocket attachments, said skirt attachment, said pocketed skirt attachment, and said sleeve attachment respectively;

selectively attaching said pocket attachments, said skirt attachment, said pocketed skirt attachment and said sleeve attachment to said belt member;

selectively suspending said pocket attachments, said skirt attachment, said pocketed skirt attachment and said sleeve attachment above ground; and, selectively suspending non-potted plants above ground by selectively attaching said sleeve attachment to said belt member and positioning the non-plotted plants within said sleeve attachment.

* * * * *